US012012813B2

(12) United States Patent
Vick, Jr. et al.

(10) Patent No.: US 12,012,813 B2
(45) Date of Patent: Jun. 18, 2024

(54) DOWNHOLE CHEMICAL REACTOR AND GAS GENERATOR WITH PASSIVE OR ACTIVE CONTROL

(71) Applicant: HALLIBURTON ENERGY SERVICES, INC., Houston, TX (US)

(72) Inventors: James Dan Vick, Jr., Dallas, TX (US); Michael Linley Fripp, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 195 days.

(21) Appl. No.: 17/738,201

(22) Filed: May 6, 2022

(65) Prior Publication Data

US 2022/0259935 A1 Aug. 18, 2022

Related U.S. Application Data

(62) Division of application No. 16/615,698, filed as application No. PCT/US2019/012752 on Jan. 8, 2019, now Pat. No. 11,352,847.

(51) Int. Cl.

| | |
|---|---|
| ***E21B 23/04*** | (2006.01) |
| ***E21B 34/06*** | (2006.01) |
| ***E21B 41/00*** | (2006.01) |

(52) U.S. Cl.

CPC ..... *E21B 23/0417* (2020.05); *E21B 23/0412* (2020.05); *E21B 34/06* (2013.01); *E21B 41/00* (2013.01)

(58) Field of Classification Search

CPC .. E21B 23/0417; E21B 23/0412; E21B 23/04; E21B 41/00; E21B 34/06

See application file for complete search history.

(56) References Cited

U.S. PATENT DOCUMENTS 5,052,482 A 10/1991 Gondouin
5,396,951 A * 3/1995 Ross ..... E21B 23/065 166/63

(Continued)

FOREIGN PATENT DOCUMENTS

CN 102444881 A 5/2012

OTHER PUBLICATIONS

International Search Report and Written Opinion; PCT Application No. PCT/US2019/012752; mailed Oct. 7, 2019.

(Continued)

*Primary Examiner* — Nicole Coy
(74) *Attorney, Agent, or Firm* — NOVAK DRUCE CARRROLL LLP

(57) ABSTRACT

A downhole chemical reactor can be placed in a downhole environment to generate gas in-situ. This gas can pressurize an inner pressure chamber of the downhole chemical reactor to create a pressure-on-demand source or to maintain a constant pressure reservoir, depending on the configuration of a reactor controller coupled to an inlet of the inner pressure chamber. The inner pressure chamber contains one or more desired chemical reactants and the reactor controller operates to permit well fluid to flow from the wellbore and into the inner pressure chamber. The well fluid reacts with the desired chemical reactants and generates one or more gases such as hydrogen or carbon dioxide. The generated gases pressurize the inner pressure chamber and a pressure regulator coupled to the inner pressure chamber maintains a maximum pressurization of the inner pressure chamber. For a constant pressure reservoir, the reactor controller repeats this cycle indefinitely.

10 Claims, 5 Drawing Sheets

(56) References Cited

U.S. PATENT DOCUMENTS

| | | | | |
|---|---|---|---|---|
| 5,452,763 | A | 9/1995 | Owen | |
| 5,960,883 | A | 10/1999 | Tubel et al. | |
| 7,591,319 | B2 * | 9/2009 | Xu | E21B 23/065 166/321 |
| 8,459,377 | B2 * | 6/2013 | Moyes | E21B 23/04 175/93 |
| 8,893,786 | B2 * | 11/2014 | Wright | E21B 34/142 166/383 |
| 8,973,657 | B2 | 3/2015 | Miller et al. | |
| 9,453,381 | B2 * | 9/2016 | Moyes | E21B 23/065 |
| 2011/0057455 | A1 | 3/2011 | Russo et al. | |
| 2013/0140027 | A1 | 6/2013 | Tilmont et al. | |
| 2013/0213032 | A1 * | 8/2013 | Xu | E21B 41/00 60/527 |
| 2014/0209310 | A1 | 7/2014 | Castrogiovanni et al. | |
| 2021/0140255 | A1 * | 5/2021 | Greci | E21B 34/14 |

OTHER PUBLICATIONS

English Abstract of CN102444881 from www.espace.com downloaded Nov. 20, 2019.

* cited by examiner

DOWNHOLE CHEMICAL REACTOR AND GAS GENERATOR WITH PASSIVE OR ACTIVE CONTROL

CROSS-REFERENCE TO RELATED APPLICATIONS

The present application is a divisional of U.S. application Ser. No. 16/615,698, filed Nov. 21, 2019, which claims benefit to international Application No. PCT/US2019/012752 filed Jan. 8, 2019, which is hereby incorporated by reference in its entirety.

TECHNICAL FIELD

The present technology pertains to downhole gas generation, and more specifically to downhole gas generation to provide a pressure reservoir or a pressure-on-demand system.

BACKGROUND

Hydraulic and pneumatic power systems have both proven to be extremely popular in not only downhole and sub-surface environments, but in the wider world as well, as these systems can be utilized for end-to-end power generation, control, and transmission. The popularity of hydraulic and pneumatic power systems stems at least in part from factors such as their easy and accurate control, their simple and economical design and maintenance requirements, their efficient force multiplication, and their ability to provide constant force and/or torque. The systems differ primarily in their choice of working fluid—hydraulic systems utilize a fluid such as an oil or a specially designed hydraulic fluid, whereas pneumatic systems utilize a gas such as ambient air or nitrogen. Hydraulic systems are known for their ability to transfer very large amounts of power through small diameter tubes and hoses, while pneumatic systems are known for their extremely fast response times.

A number of existing downhole and borehole tools are designed to run on hydraulic or pneumatic power, or can otherwise be converted to run on hydraulic or pneumatic power. However, these tools are almost always powered from the surface, as typically large combustion engines are used to charge the accumulator(s) of the hydraulic or pneumatic system. When powering from the surface, the hydraulic or pneumatic lines may need to stretch for long distances in order to reach a tool at the bottom of a deep borehole, or become subject to snapping or other damage when passing through an area of adverse environmental conditions, both of which can reduce not only the efficiency of the hydraulic or pneumatic system, but can also reduce the viability of using such a system in the downhole environment.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It should be understood at the outset that although illustrative implementations of one or more embodiments are illustrated below, the disclosed apparatus and methods may be implemented using any number of techniques. The disclosure should in no way be limited to the illustrative implementations, drawings, and techniques illustrated herein, but may be modified within the scope of the appended claims along with their full scope of equivalents.

Disclosed herein is a downhole chemical reactor which is capable of generating one or more gases for providing pressure-on-demand or filling and maintaining a constant pressure reservoir. The downhole chemical reactor can be placed in a wellbore or other downhole environment for purposes of in-situ gas generation, and the resultant pressure from the generated gas can be used to drive one or more hydraulic or pneumatic tools, which may be located in the same wellbore or downhole environment as the chemical reactor. One or more desired reactants are contained within an inner chamber of the chemical reactor, where the reactants are selected such that they react with one or more well fluids (such as the well brine surrounding the downhole chemical reactor) to generate the one or more gases. Different reactor control mechanisms or reactor controllers can be employed in order to flood the downhole chemical reactor with a suitable amount of fluid for the reaction, as will be explained in greater depth below. In general, the different reactor control mechanisms or reactor controllers can be differentiated as passive or active, and/or can be differentiated on the basis of whether or not they configure the downhole reactor to provide a pressure-on-demand system or a constant pressure reservoir system.

Figure 1:
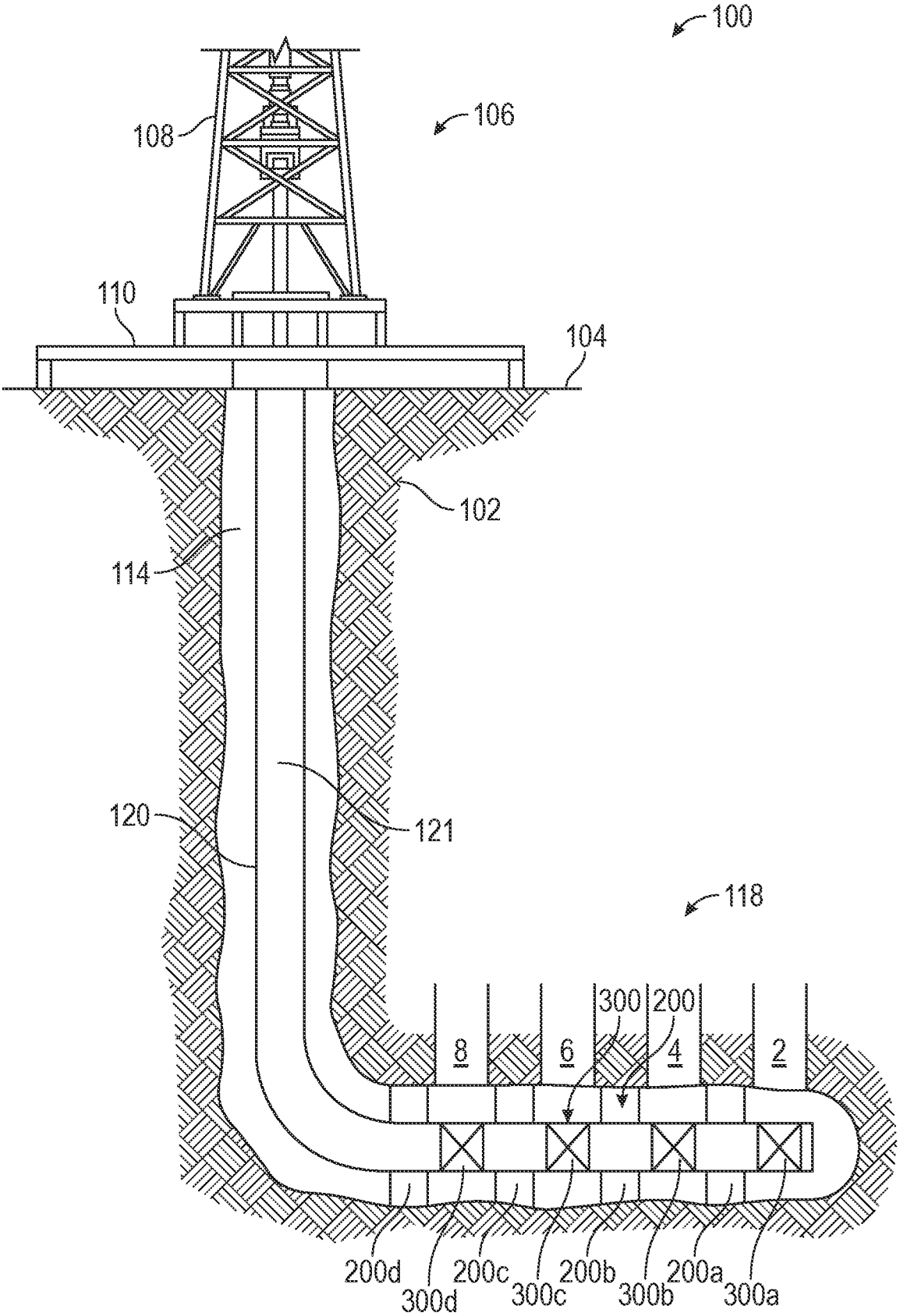
FIG. 1 is a schematic view of a wellbore operating environment in which certain exemplary embodiments of the present disclosure may operate.

FIG. 1 illustrates a schematic view of an embodiment of a wellbore operating environment in which a downhole chemical reactor for gas generation may be deployed. As depicted in FIG. 1, the operating environment 100 includes a wellbore 114 that penetrates a formation 102 that includes a plurality of formation zones 2, 4, 6, and 8 for the purpose of recovering hydrocarbons, storing hydrocarbons, disposing of carbon dioxide, or the like. As depicted in FIG. 1, formation 102 is a subterranean formation, although it is noted that formation 102 may be a subsea formation. The wellbore 114 may extend substantially vertically away from the Earth's surface over a vertical wellbore portion, or may deviate at any angle from the Earth's surface 104 over a deviated or horizontal wellbore portion 118. In alternative operating environments, portions or substantially all of the wellbore 114 may be vertical, deviated, horizontal, and/or curved. The wellbore 114 may be drilled into the formation 102 using any suitable drilling technique. As shown, a drilling or servicing rig 106 disposed at the surface 104 (which may be the surface of the Earth, a seafloor surface, or a sea surface) comprises a derrick 108 with a rig floor 110 through which a tubular string (e.g., a drill string, a tool string, a segmented tubing string, a jointed tubing string, or any other suitable conveyance, or combinations thereof) generally defining an axial flowbore may be positioned within or partially within the wellbore 114. The tubular strings may include two or more concentrically positioned strings of pipe or tubing (e.g., a first work string may be positioned within a second work string). The drilling or servicing rig 106 may be conventional and may include a motor driven winch and other associated equipment for lowering the tubular string into the wellbore 114. Alternatively, a mobile workover rig, a wellbore servicing unit (e.g., coiled tubing units), or the like may be used to lower the work string into the wellbore 114. In such an environment, the tubular string may be utilized in drilling, stimulating, completing, or otherwise servicing the wellbore, or combinations thereof.

While FIG. 1 depicts a stationary drilling rig 106, one of ordinary skill in the art will readily appreciate that mobile workover rigs, wellbore servicing units (such as coiled tubing units), and the like may be employed. In the context of subsea environments and/or subsea formations, one of ordinary skill in the art will appreciate that conventional fixed platforms, vertically moored platforms, spar platforms, semi-submersible platforms, floating production facilities, and sub-sea completion facilities and the like may be employed. It is noted that while the Figures or portions thereof may exemplify horizontal or vertical wellbores, the principles of the presently disclosed apparatuses, methods, and systems, may be similarly applicable to horizontal wellbore configurations, conventional vertical wellbore configurations, deviated wellbore configurations, and any combinations thereof. Therefore, the horizontal, deviated, or vertical nature of any figure is not to be construed as limiting the wellbore to any particular configuration or formation.

As depicted in FIG. 1, at least a portion of the wellbore 114 is lined with a wellbore tubular 120 such as a casing string and/or liner defining an axial flowbore 121. In at least some instances, one or more packer assemblies 200, such as a first packer assembly 200*a*, second packer assembly 200*b*, third packer assembly 200*c*, and fourth packer assembly 200*d*, may be disposed within the wellbore 114. In some instances, the one or more packer assemblies 200 may be used to isolate two or more adjacent portions or zones within formation 102 and/or wellbore 114. In some cases, the one or more packer assemblies 200 are operable to engage and/or seal against an outer tubular string such as tubular string 120. According to at least one aspect of the present disclosure, at least a portion of the wellbore tubular 120 is secured into position against the formation 102 via a plurality of packer assemblies 200, such as assemblies 200*a*-200*d*. In at least some instances, a portion of the wellbore tubular 120 may be partially secured into position against the formation 102 in via cement, e.g. when wellbore tubular 120 is a casing.

As depicted in FIG. 1, the operating environment 100 may further include at least one downhole tool 300 (e.g., a first downhole tool 300*a*, a second downhole tool 300*b*, a third downhole tool 300*c*, and a fourth downhole tool 300*d*). The downhole tools may be any variety of downhole tools such a sleeve, a valve, a piston, a sensor, or an actuator to inflate the packers 200, or other devices.

In many scenarios, it can be desirable to couple a hydraulic or pneumatic power system to one or more components within wellbore 114, and in particular, to one or more components of the tubular strings (e.g. wellbore tubular 120) positioned within wellbore 114. For example, a pneumatic power system can be used to inflate one or more of the packer assemblies 200*a*-200*d*, and a hydraulic power system can be used to control, operate, or otherwise actuate one or more of the downhole tools 300*a*-300*d*. In either use case, conventional hydraulic and pneumatic power systems will rely upon one or more large and high-powered mechanical pumps or compressors to generate and apply the requisite pressure to the working fluid of the system. However, these mechanical pumps and compressors (and their corresponding support infrastructure and maintenance requirements) are often times impractical or even impossible to implement in challenging or changing environments such as those associated with subsea formations and subsea wellbores, and are too large to be physically installed downhole, meaning that subsea oil and gas operations will often forego their use. Accordingly, as disclosed herein, it would be highly desirable to provide a downhole chemical reactor for creating hydraulic or pneumatic pressure, either on demand or within a charged accumulator, without using a mechanical or electrical pump.

Figures 2A, 2B, 2C:
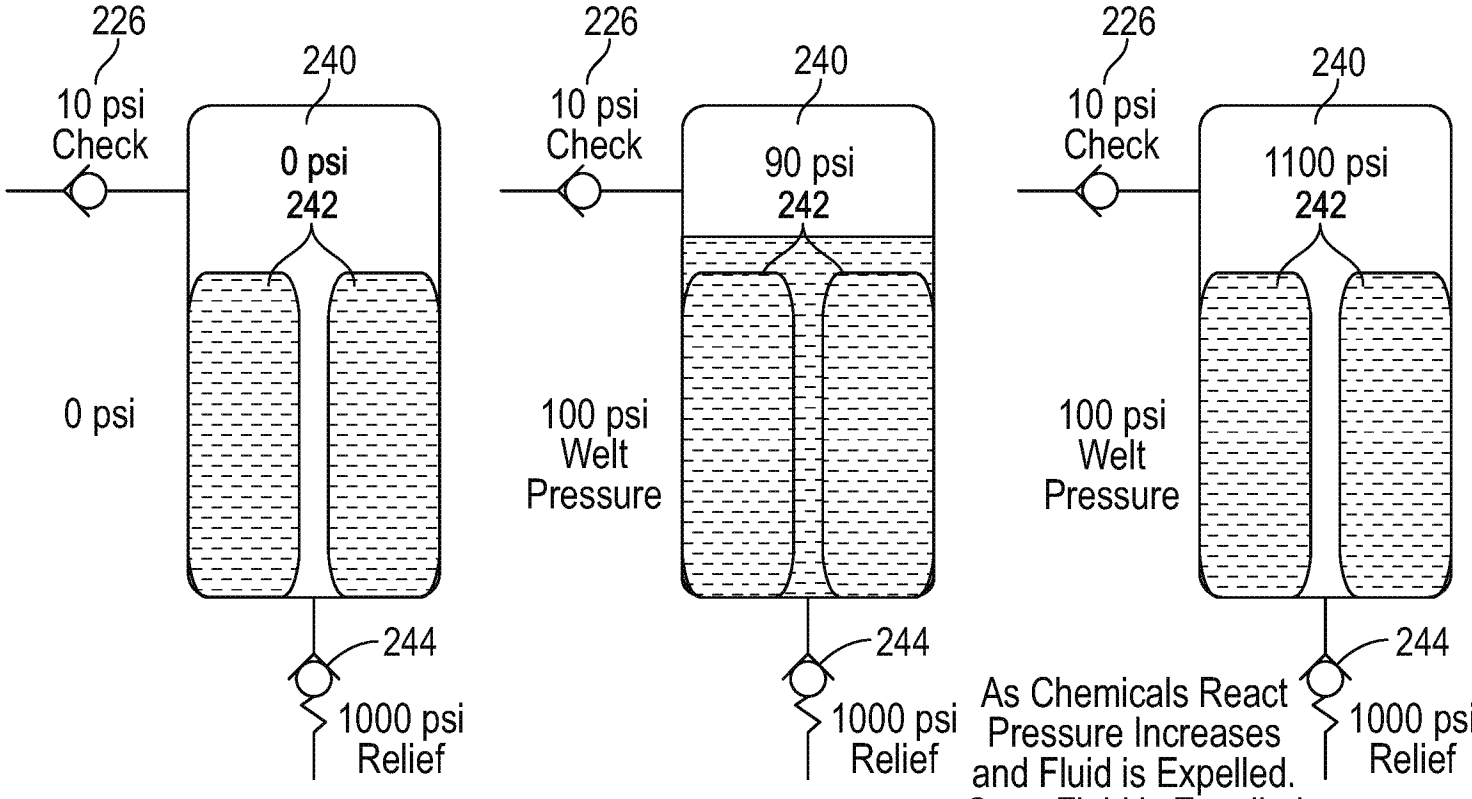
FIGS. 2A-C are schematic views of an exemplary downhole chemical reactor as it transitions from an un-pressurized state to a pressurized state.

FIGS. 2A-2C depict a downhole chemical reactor 240 as it goes from an uncharged (or minimally pressurized) state in FIG. 2A (shown here as ~0 psi within the reactor 240) to a fully charged (or maximally pressurized) state in FIG. 2C (shown here as ~1100 psi, although other maximum pressurizations are possible, as will be explained below). It is noted that the pressure values discussed herein are taken relative to another pressure, such as relative to hydrostatic pressure, to an ambient pressure, or to a reference pressure. The downhole chemical reactor 240 contains, in its interior, an inner pressure chamber which itself contains a reactant 242, such as an anhydrous acid, although other reactants are possible and additional examples are discussed herein. Reactant 242 can be selected on the basis of its ability to react with one or more wellbore fluids, which most typically are brines, to yield a gas, which most typically is hydrogen or carbon dioxide. Although the downhole chemical reactor 240 as shown in FIGS. 2A-C provides a one-time use, pressure-on-demand functionality, it is nevertheless provided with a reactor controller mechanism by way of a check valve 226. Check valve 226 is installed on the fluid intake of the chemical reactor 240, and is shown here as having an exemplary 10 psi cracking pressure, which is the minimum pressure required in order for the check valve 226 to open. It is noted that various different cracking pressures for check valve 226 can be employed without departing from the scope of the present disclosure. Downhole chemical reactor 240 is additionally configured with a pressure regulator in order to regulate or otherwise control downhole chemical reactor 240 to not exceed the maximum pressurizations discussed above. As shown in FIG. 1, this pressure regulator may comprise a relief valve 244, which is depicted as having a set pressure of 1000 psi, although various other set points or set pressures can be employed without departing from the scope of the present disclosure. Factors that can influence the selection of reactant 242 (and which may also influence the rate of the gas generation reaction) include but are not limited to: the chemical composition of the salts within the well brine or well fluid; the pH of the well fluid; the temperature of the well fluid, or if different, the temperature within downhole chemical reactor 240; the desired amount of pressure and/or gas; and the volume of the downhole chemical reactor 240. In most scenarios, it is contemplated that the gas generation reaction to fully charge downhole chemical reactor 240 to its desired maximum pressure will take place on the order of minutes or hours, although of course longer time scales are possible depending upon the specific selection of reactant(s) 242 and the ambient downhole conditions.

As mentioned previously, FIG. 2A depicts the downhole chemical reactor 240 in an uncharged or minimally pressurized state—the internal pressure of its inner pressure chamber and the external pressure of the wellbore/downhole environment are balanced (shown here as both being 0 psi). In this uncharged state, no fluid is present within downhole chemical reactor 240 and reactant 242 is not involved with any ongoing gas-producing reaction. This uncharged state might be associated with downhole chemical reactor 240 before it has been installed in a downhole environment, an environment which is the primary contributing factor causing the external pressure surrounding downhole chemical reactor 240 to increase, as illustrated in FIG. 2B. In some embodiments, the external pressure surrounding downhole chemical reactor 240 may be a natural product of the wellbore/downhole environment, e.g. generally tends to increase with depth. In some embodiments, the external pressure surrounding downhole chemical reactor 240 may be externally influenced, for example by pumping into the wellbore or annulus to increase the pressure acting on the downhole chemical reactor 240.

In FIG. 2B, downhole chemical reactor 240 has been installed into a downhole environment (or is in the process of being installed into a downhole environment), where the downhole well environment is associated with an exemplary current well pressure of 100 psi. Because the well pressure exceeds the interior pressure of downhole chemical reactor 240 (or more specifically, exceeds the pressure of the inner pressure chamber of reactor 240) and because the well pressure also exceeds the 10 psi cracking pressure of check valve 226, check valve 226 opens and allows well brine (or some other surrounding well fluid) to flow into and fill the interior volume (also referred to herein as the 'inner pressure chamber') of downhole chemical reactor 240. This filling process is indicated by the increased fluid level within chemical reactor 240 as seen in FIG. 2B compared to FIG. 2A. Check valve 226 remains open and well brine continues to flow into the inner chamber of downhole chemical reactor 240 until the reactor pressure reaches equilibrium with the well pressure. Here, the equilibrium pressure is approximately 90 psi, and in general the equilibrium pressure can be determined as the difference between the external well pressure acting on downhole chemical reactor 240 and the cracking pressure of check valve 226. As such, the equilibrium pressure can be made higher or lower (for a given well pressure) by respectively increasing or decreasing the cracking pressure of check valve 226. The equilibrium pressure can also be adjusted by re-positioning downhole chemical reactor 240 within the wellbore or downhole environment, such that the external well pressure acting on the reactor changes. In some embodiments, downhole chemical reactor 240 might be flooded upon installation, such that its pressurized reservoir is fully charged for immediate use. However, due to leakage or gradual loss of pressure, it can be desirable for downhole chemical reactor 240 to be installed in the downhole environment without being flooded, such that the pressurized reservoir can be charged in response to a direct or indirect command from the surface when it is determined at some future time to be needed.

As well brine flows in and fills the inner chamber of downhole chemical reactor 240, the well brine begins to react with at least a portion of reactant 242. In some embodiments, reactant 242 might comprise a single chemical compound, or might comprise a mixture of various different chemical compounds, each of which will react with a different well fluid or will react for a given set of reactor conditions. In this manner, downhole chemical reactor 240 can generate gas for a wider range of well fluids and can do so in a wider range of downhole conditions. In some embodiments, reactant 242 can comprise one or more of a magnesium alloy or an aluminum alloy, which react with well brine to generate hydrogen gas. In some embodiments, reactant 242 can comprise calcium, which reacts to produce calcium hydroxide and hydrogen. In some embodiments, reactant 242 can comprise zinc and the well fluid is an acid used in a wellbore cleanup operation, the two of which will react to generate hydrogen gas. More generally, it is contemplated that reactant 242 can comprise one or more metals, which will react to form a metal oxide, which then further reacts to produce a metal hydroxide and hydrogen gas. In some embodiments, rather than selecting reactants 242 to generate hydrogen gas, reactants 242 can be selected to react with the well fluid to generate carbon dioxide.

In some embodiments, the volume of the inner chamber of downhole chemical reactor 240, and therefore the volume of well brine that floods the reactor, can far exceed the volume of fluid required to react with reactant 242 to generate sufficient gas to reach the maximum pressurization defined by relief valve 244. For example, downhole chemical reactor 240 might have a volume of about 38 liters (L) (about 10 gallons) when only about 236 milliliters (ml) (about 1 cup) of water is required for the gas generation reaction, although of course other reactor volumes and minimum fluid requirements are possible without departing from the scope of the present disclosure. Nevertheless, regardless of the precise ratio between the reactor volume and volume of fluid required, it is very frequently the case that excess fluid will be present within the inner chamber of downhole chemical reactor 240. However, downhole chemical reactor 240 is self-regulating to stabilize at its maximum pressure and expel any excess fluid before it can react further and waste any significant amount of reactant 242, as will be explained below.

As the well brine reacts with reactant 242 and gas is generated, the internal pressure of downhole chemical reactor 240 increases, as the newly generated gas is unable to exit through the one-way check valve 226 and is, as of yet, insufficiently pressurized to open relief valve 244, which for example may have an opening pressure of 1000 psi. Accordingly, the downhole chemical reactor 240 will continue to increase in pressurization until either an insufficient quantity of raw material (e.g. well brine or reactant 242) remains or until its internal pressure reaches the maximum defined by relief valve 244. As seen in FIG. 2C, the maximum internal pressure of downhole chemical reactor 240 is, as an example, 1100 psi, at which point relief valve 244 will open. Because well fluid is almost always denser than the gas generated within downhole chemical reactor 240, the well fluid will be forced out of relief valve 244 before the generated gas, due to the positioning of relief valve 244 on the bottom portion of downhole chemical reactor 240. Assuming that reactant 242 is not a limiting factor in the gas generating reaction, such a design advantageously terminates the reaction in a more expeditious fashion by removing what is at this point merely excess well fluid within downhole chemical reactor 240, until downhole chemical reactor 240 reaches the final charged state depicted in FIG. 2C, where there is no longer any well fluid left (and hence the gas generating reaction has terminated). Although relief valve 244 is shown here as having a set pressure of 1000 psi and downhole chemical reactor 240 is shown as being associated with a maximum pressurization of 1100 psi, it is appreciated that these values are provided by way of example and are not meant to be limiting. Various relative pressures for one or more portions or components of the environments, downhole chemical reactors, reactor control mechanisms, reactor controllers, pressure regulators, and so on of the present disclosure can be associated with various other relative pressure values as desired, and as depends on reactor design and the downhole conditions. As an example, relief valve 244 (or other pressure regulators included in the scope of the present disclosure) may for instance be configured in a range of about 50 to 1500 psi, and downhole chemical reactor 240 may have a maximum pressurization in a range of about 150 to 1600 psi.

Thus, as mentioned above, downhole chemical reactor 240 is self-regulating via the relief valve 244—relief valve 244 may open a first time to expel, for example, half of the well fluid contained within downhole chemical reactor 240 before closing, at which point the gas generation reaction will raise the interior pressure of the reactor until relief valve 244 opens once again to expel an additional portion of the remaining half of the well fluid contained within the reactor. This process will continue until there is no well fluid left. The set pressure of the relief valve sets the maximum pressure differential that the downhole chemical reactor 240 may achieve above the well pressure. If this maximum pressure differential is ever exceeded, then relief valve 244 will act to expel any excess pressure and any excess well fluid to ensure that any wastage of reactant 242 is minimized. Thus, in this manner relief valve 244 is coupled to the inner pressure chamber of downhole chemical reactor 240 in order to act as a pressure regulator to control a maximum pressurization of the inner pressure chamber. Such a functionality is particularly useful in permanent installations where it is not contemplated that downhole chemical reactor 240 will ever be removed for servicing or replenishment of its supply of reactant 242.

However, the design of downhole chemical reactor 240 as depicted is not self-replenishing, as it possesses no mechanism to re-flood its inner chamber an initiate additional gas generation reactions to re-pressurize itself. In other words, downhole chemical reactor 240 is shown as a one-time use reactor—its 1100 psi charged volume can be used to perform work until being reduced to the 90 psi equilibrium pressure (described above as being based upon the external well pressure and the cracking point of check valve 226), at which point downhole chemical reactor 240 is in a fully depleted state.

Figure 3A:
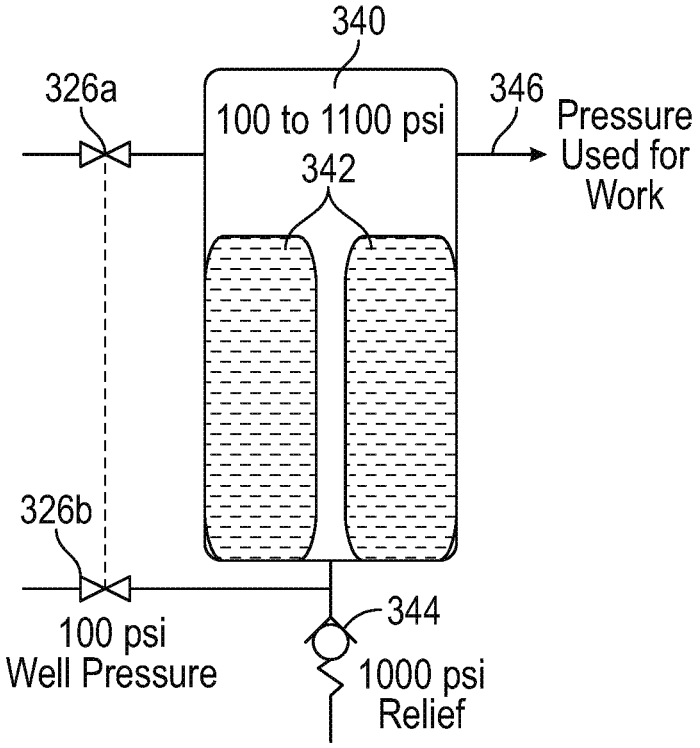
FIG. 3A is a schematic view of an exemplary on-demand downhole chemical reactor with multi-valve reactor control mechanism.

Accordingly, FIG. 3A depicts a downhole chemical reactor 340 which permits pressure to be generated multiple times in an on-demand fashion. That is, downhole chemical reactor 340 is fitted with a reactor controller capable of refilling reactor 340 or otherwise capable of resetting reactor 340 and initiating an additional gas generation reaction to provide an additional on-demand pressure.

In some embodiments, downhole chemical reactor 340 can be identical to previously described downhole chemical reactor 240, with the exception of this different reactor controller described above. In particular, FIG. 3A depicts downhole chemical reactor configured with a reactor controller comprising an upper valve 326*a* and a lower valve 326*b* that can be controlled from the surface to flood downhole chemical reactor 340 multiple times. In scenarios in which pressurization will be needed on an infrequent basis, it is typically unnecessary to maintain a constant pressure reservoir, and downhole chemical reactor 340 is suitable to meet this infrequent use case.

When it is determined that a pressure source is needed downhole, such as to power a packer assemblies 200 or downhole tool 300, e.g. to inflate a packer, move a sleeve, power a downhole tool, open a valve, move a piston etc., a command can be received to open both the upper valve 326*a* and the lower valve 326*b*. These valves can be electrically controlled, mechanically controlled, hydraulically controlled, or controlled via any other known valve control mechanism, and as mentioned previously, it is contemplated that these valves are controlled in response to one or more commands received from the surface. In some embodiments, a small downhole battery might be present (or combined with the downhole chemical reactor), such that only control commands need be received from the surface, leaving the downhole tool(s) and/or borehole assembly fully self-powered, with the downhole battery providing electrical needs for low to moderate power applications and the downhole chemical reactor providing hydraulic/pneumatic needs for high power applications. In some embodiments, the downhole battery can be supplemented with or replaced by electrical supply lines from the surface, which might also carry wireline or other communications and commands, although in such embodiments the downhole chemical reactor remains better suited for high power hydraulic and pneumatic applications, as even surface electrical power supply may be insufficient.

Returning now to the discussion of the upper valve 326*a* and the lower valve 326*b*, with both valves open, any excess gas (e.g. generated in a previous cycle that did not fully empty the reactor) within the inner chamber of downhole chemical reactor 340 is vented until the reactor pressure reaches equilibrium with the well pressure. This excess gas vents from upper valve 326*a*. Once this equilibrium is reached, a volume of well fluid enters downhole chemical reactor 340 from the bottom, via lower valve 326*b*, while a corresponding volume of gas is displaced through upper valve 326*a*.

Upper valve 326*a* and lower valve 326*b* are then closed, allowing pressure to build within downhole chemical reactor 340 as was described above with respect to FIGS. 2A-C. Downhole chemical reactor 340 is also self-regulating to expel any excess pressure and excess fluid via relief valve 344, via a similar or identical pressure regulator as downhole chemical reactor 240, although it is also possible that one or more of upper valve 326*a* and lower valve 326*b* could also be opened and closed to achieve the same or similar regulatory effect. Additionally, in some embodiments it can be possible to meter (via a dedicated sensor or via an inference/estimate) the amount of well fluid that floods the inner chamber of downhole chemical reactor 340, such that a minimal amount of excess well fluid is permitted to enter. For example, continuing the example of about a 38 L reactor volume and about 236 ml required quantity of well fluid, the upper and lower valves 326*a,b* might be closed as soon as it is determined that about 236 ml of well fluid has entered. In some embodiments, it can be desirable to close the valves after determining some quantity of well fluid in excess of the minimum required has entered downhole chemical reactor 340, as once the valves are closed and the reactor reaches some pressure above the well pressure, there is no way to intake additional well fluid without first venting the generated gas and returning the reactor to equilibrium with the well pressure. Although about 38 L and about 236 ml are used herein as examples, any relative amounts may be employed depending on the reactor size, amounts of reactants, and wellbore conditions.

In some embodiments, rather than using a discrete upper valve 326*a* and lower valve 326*b* to provide the reactor controller, a single large-diameter inlet valve could be used as the reactor controller, where its diameter is large enough to permit the simultaneous ingress of well fluid and egress of gas from the downhole chemical reactor 340. An advantage of using a single large-diameter inlet valve as the reactor controller is that there is no need for coordinating the open and close timings like there is with the upper valve 326*a* and lower valve 326*b*, which should operate in substantially synchronous fashion in order to minimize unexpected or undesirable movements of well fluid and reactor gas. However, the single large-diameter inlet valve is generally unable to selectively vent either gas or well fluid, as is possible with the upper valve 326*a* and lower valve 326*b*, as the inlet to the single large-diameter valve on the interior of downhole chemical reactor 340 will almost always be fully covered by the well fluid (if the single valve is located towards the bottom portion of the reactor) or fully covered by the reactor gas (if the single valve is located towards the upper portion of the reactor).

Figure 3B:
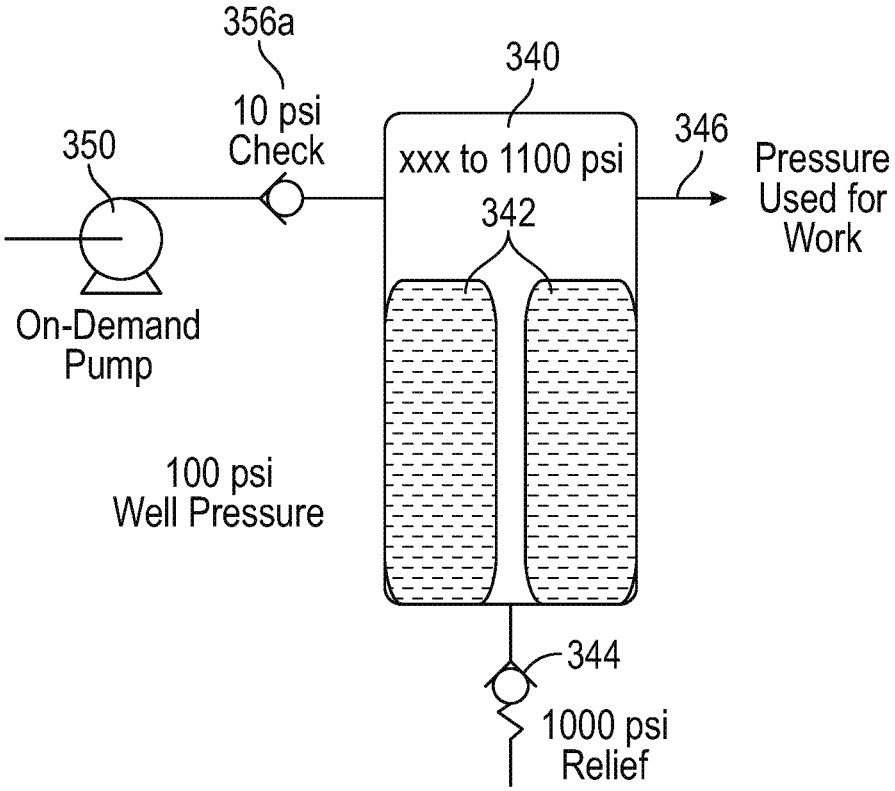
FIG. 3B is a schematic view of an exemplary on-demand downhole chemical reactor with pumped reactor control mechanism.

FIG. 3B depicts an embodiment in which downhole chemical reactor 340 is configured with a reactor controller comprising a small downhole pump 350. Pump 350 preferably is located in close proximity to the downhole chemical reactor, although this is not required. In some embodiments, the downhole pump 350 is electrical in nature and can be driven by a downhole battery, such as the one discussed above for optionally actuating the upper and lower valves 326*a,b* or the single large-diameter valve. In a similar advantage, the use of the pump 350 allows a small amount of electrical power to be leveraged to release a large amount of chemical energy (via the gas generation reaction within reactor 340), which can then be utilized as a direct source of downhole hydraulic or pneumatic pressure. This is particularly advantageous, as discussed previously, in oil and gas environments or operations where the use of large, conventional hydraulic or pneumatic systems is not logistically or financially feasible, such as subsea environments.

A check valve 356 is interposed between the output of downhole pump 350 and the inlet of downhole chemical reactor 340, shown here as having a cracking pressure of 10 psi. Here, the primary purpose of check valve 356 is to provide a one-way flow such that well fluid may be pumped into the downhole chemical reactor 340 by the pump 350, but gas cannot flow out of the reactor via this same path. As such, check valve 356 can more generally be selected to have a cracking pressure sufficiently low that pump 350 need not be high-powered.

In operation, pump 350 functions as the reactor controller by moving a desired volume of well fluid from the wellbore and into the inner pressure chamber of downhole chemical reactor 340, which causes the reactor to become pressurized by the gas generation reaction of the well fluid with reactant 342. The amount of well fluid pumped into the inner chamber of downhole chemical reactor 340 can many times be more precisely metered via pump 350 than it can be when using either the upper and lower inlet valves 326*a,b* or the singe large-diameter inlet valve. Additionally, pump 350 may be sufficiently powerful to pump against a pressure gradient such that well fluid may be pumped into downhole chemical reactor 340 even when the reactor is partially pressurized, which was not necessarily possible in either of the inlet valve configurations discussed above. As such, downhole chemical reactor 340 in this pump-driven configuration is not associated with a minimum or equilibrium pressure that depends strictly upon the external well pressure surrounding the reactor, although it is noted that the maximum pressure as shown does still depend upon a combination of the external well pressure and the set point of the pressure regulator comprising relief valve 344.

Instead, downhole chemical reactor 340 can have a minimum pressure that is controllable or adjustable via pump 350. For example, assuming that pump 350 is sufficiently powerful, it can be configured to pump in some additional volume of well fluid every time downhole chemical reactor 340 falls below a desired minimum pressurization, e.g. trigger pump 350 when the reactor pressure falls below 250 psi. Advantageously, this can maintain a more reliable source of pressure by avoiding a state where the downhole chemical reactor 240 reaches equilibrium with the pressure of the surrounding well. However, such a configuration is more power intensive, requires relatively frequent operation of pump 350, and can require a much larger and more powerful pump 350 than is feasible in the downhole environment. Indeed, operation of pump 350 in the manner described above effectively causes it to function in a manner similar to conventional surface hydraulic or pneumatic systems, which constantly run one or more pumps to maintain a pressure reservoir.

Accordingly, it would be desirable to provide a downhole chemical reactor with a pumping system capable of leveraging natural variations within the wellbore or downhole environment to thereby maintain the downhole chemical reactor as a constant pressure reservoir without requiring an electrical or similar mechanical pump.

Figure 4:
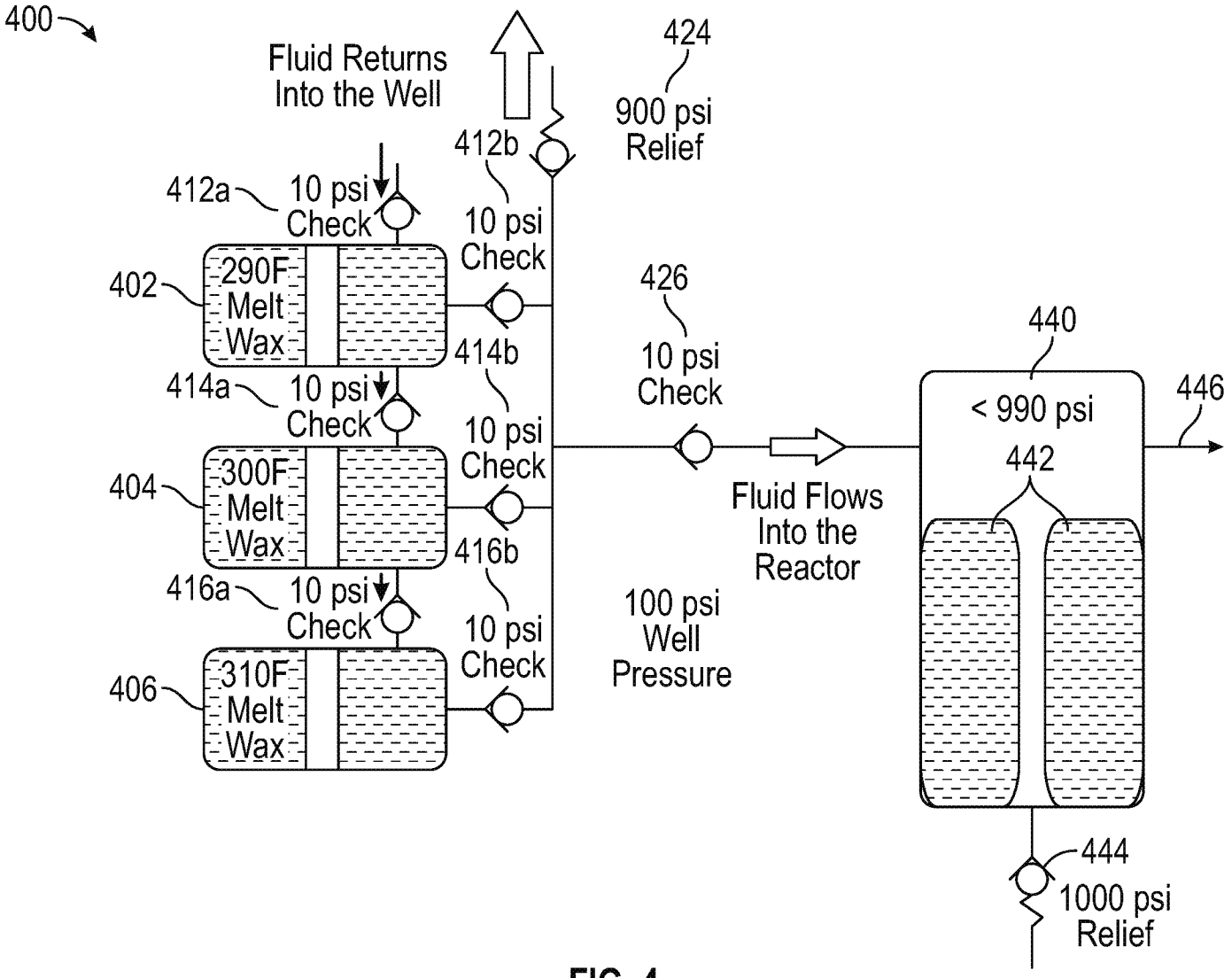
FIG. 4 is a schematic view of an exemplary on-demand downhole chemical reactor with a phase change pump system to provide a continuous pressure reservoir based on downhole variations.

FIG. 4 depicts a downhole chemical reactor 440 (which in some embodiments can be similar or identical to one or more of the downhole chemical reactors 240, 340 described above) configured with a reactor controller comprising a phase change pump system 400. In some embodiments, phase change pump system 400 may comprise a wax pump system, as is the case in the context of the illustrative example below. However, it is understood that reference to a wax pump system is not to be construed as limiting, and that the phase change pump system 400 described below may instead be replaced by various other phase change pump systems that do not rely upon wax as their actuation fluid but include any material which may undergo a phase change and/or volume change (the phase change may result in a volume change) in response to one or more predetermined temperature thresholds. The phase change material which may be used includes for example, synthetic or natural waxes, petroleum derived waxes, paraffin waxes, microcrystalline wax, polymers or copolymers, polyethylene or polypropylene polymers, resins, long chain aliphatic hydrocarbons, including alkanes, alkenes, as well as esters, carboxylic acids, alcohols, ketones, aldehydes and derivatives thereof having long alkyl (saturated or unsaturated) chains. Various factors, such as the number of carbons, molecular weight, branching and saturation can be adjusted to obtain the desired melt temperature of the wax or polymer. The phase change material may undergo phase change, solidifying or melting, and may be selected to have melting points within the range of at least 120° F., alternatively, at least 250° F., alternatively, at least 300° F., alternatively, at least 340° F., or alternatively within a range from about 120° F. to about 350° F., alternatively from about 250° F. to about 350° F. A pump system 400 may include a plurality of phase change materials each having a different melting point, for instance, a first material at 290° F., a second material at 300° F., a third material at 310° F., and so on across a desired range. Such temperatures are merely illustrative, and as such, any number of different melting points can be selected by adjusting or selecting the corresponding phase change material for any plurality of selected different melting points.

For the sake of illustration and consistency with prior examples, downhole chemical reactor 440 is depicted as experiencing the same external well pressure of 100 psi and as having the same 1000 psi set point for its pressure regulator relief valve 444, although it is appreciated that one or both of these parameters could vary or otherwise be adjusted without departing from the scope of the present disclosure.

As illustrated, the reactor controller provided by phase change pump system 400 comprises a first phase change pump 402 having a melting point of 290° F., a second phase change pump 404 having a material with a melting point of 300° F., and a third phase change pump 406 having a material with a melting point of 310° F., although other numbers of melting points are possible without departing from the scope of the present disclosure. The phase change pumps 402, 404, 406 each have an inlet with a check valve 412*a*, 414*a*, 414*c*, respectively, and each have an outlet with a check valve 412*b*, 414*b*, 416*c*, respectively. The inlets draw from the well fluid in the downhole environment and the outlets discharge into the downhole chemical reactor 440. As shown here, all six of the check valves have the same 10 psi cracking pressure, although the choice of cracking pressure can be chosen to better match the individual pumping characteristics of each phase change pump and/or the expected downhole conditions and temperature variations.

In operation, thermal variations within the downhole environment will cause the phase change pumps 402-406 to variously and intermittently go through melting and solidifying cycles, which leverages the volume change associated with this change of state to drive the pumping action of the overall phase change pump system 400. In particular, the phase change pumps 402-406 are can be configured such that they experience a 10-20 percent change in volume when going from solid to liquid, and vice versa. For instance, the volume change may be in an increase in volume when heated (melting) and a decrease in volume when cooled (solidifying).

The phase change material, such as wax, located on the left-hand side of each phase change pump in a phase change compartment separated from a fluid compartment on the right-hand side of the phase change pump. The phase change compartment and fluid compartment are separated by by a membrane, piston, or other moveable partition that effectively seals the two compartments to prevent intermingling of the phase change material and well fluid. When the phase change material solidifies, it reduces in volume and causes the phase change material compartment to contract. The fluid compartment undergoes a corresponding expansion, which allows well fluid to overcome the cracking pressure of the check valve on the inlet of the phase change pump and then flow into the fluid compartment to occupy the newly expanded volume. When the phase change material melts, it increases in volume and causes the phase change compartment to expand. The fluid compartment undergoes a corresponding contraction, which forces a portion of the well fluid contained within the fluid compartment to be discharged through the outlet of the phase change pump.

The outlets of the three phase change pumps 402-406, after passing through their respective check valves 412*c*-416*c*, are connected by a common conduit, seen in FIG. 4 as the vertical branch interconnecting the phase change pumps. This common conduit has a first branch terminating in a relief valve 424 (shown here with a 900 psi set pressure) and having a second branch terminating at an inlet of the downhole chemical reactor 440 (after passing through a check valve 426, shown with a 10 psi cracking pressure). The relief valve 424 determines the maximum pressure that can exist within the common conduit, and in the case of FIG. 4, the maximum pressure for the common conduit is 1000 psi, as this is the pressure sufficient to overcome the 900 psi set pressure of relief valve 424 and the 100 psi external pressure of the wellbore/downhole environment.

As long as the pressure of downhole chemical reactor 440 exceeds 990 psi, then phase change pumps 402-406 will circulate well fluid indefinitely, as any amount of well fluid discharged into the common conduit via the phase change pump outlets will cause a corresponding discharge via the relief valve 424. However, once the pressure of downhole chemical reactor 440 falls below 990 psi, for example because some or all of the gas within the reactor is utilized to perform work, it then becomes easier for the common conduit to discharge well fluid into the reactor via check valve 426 than to discharge into the wellbore via relief valve 424. Note that this process can occur even as pressure from downhole chemical reactor 440 is actively being used, meaning that the reactor can be recharged in substantially real-time.

The discharge of well fluid into downhole chemical reactor 440 may be small, but recall that only a small volume of well fluid is required to react with reactant 442 to generate a large amount of gas within the downhole chemical reactor. Accordingly, downhole chemical reactor 440 will be repressurized to somewhere between 990 psi (its minimum pressure) and 1100 psi (its maximum pressure before the 1000 psi relief valve 444 is triggered). Downhole chemical reactor 440 then lays dormant, with the phase change pump system 400 discharging well fluid via the 900 psi relief valve 424, until the pressure source of the downhole chemical reactor is called upon again to perform work. Downhole chemical reactor will then fall below 990 psi and the refilling cycle repeats to recharge the reactor once again, thereby providing the desired constant pressure source in the downhole environment.

Advantageously, phase change pump system 400 and downhole chemical reactor 440 can provide a constant pressure source in the downhole environment entirely without the use of electricity or a conventional mechanical pump. The phase change pump system 400 is self-sustaining and draws energy wholly from the thermal fluctuation in the surrounding downhole environment, allowing downhole chemical reactor to function in a self-contained and stand-alone fashion nearly indefinitely, limited only by the exhaustion of the supply of reactant 442 or by the lack of sufficient thermal gradients to drive the phase change pump system 400.

However, it is rarely the cause that the wellbore or downhole environment remains thermally static, as temperature changes can happen often and for a variety of different reasons. For example, temperature changes will very frequently be strongly associated with one or more areas where fluid is being injected. The fluid injection itself tends to cool the wellbore environment, meaning that a greater injection rate will typically be associated with a colder temperature. Similarly, the temperature of the injected fluid can be a driving factor, most notably when comparing the far colder injected fluid temperatures associated with injecting at night rather than during the day. Even if the fluid is heated at the surface prior to injection (e.g. steam injection) a temperature variation between night and day will be observed, or a rate-based temperature variation will be observed. As a still further example, fluid injection might be cycled with intervals of producing from the wellbore, which can in many cases lead to rather large temperature variations. The production rate can also lead to temperature variation, as the produced fluid is typically coming from a lower (hotter) location in the wellbore, meaning that a reduced production rate will lead to a cooler wellbore temperature than an increased production rate. Closing off or shutting in the well can additionally lead to temperature variations, and indeed, any of the temperature variations described above (which can occur either naturally within the well or as a consequence of planned operations within the well) can be intentionally induced in order to drive the phase change pump system 400 in a desired fashion. For example, if it is observed that the downhole chemical reactor 440 needs to be re-pressurized but the wellbore temperature is too low to drive phase change pump system 400, then steam could be injected from the surface or the injection rate could be reduced with the intention of raising the ambient downhole temperature in order to drive one or more cycles of the phase change pump system 400.

Figure 5:
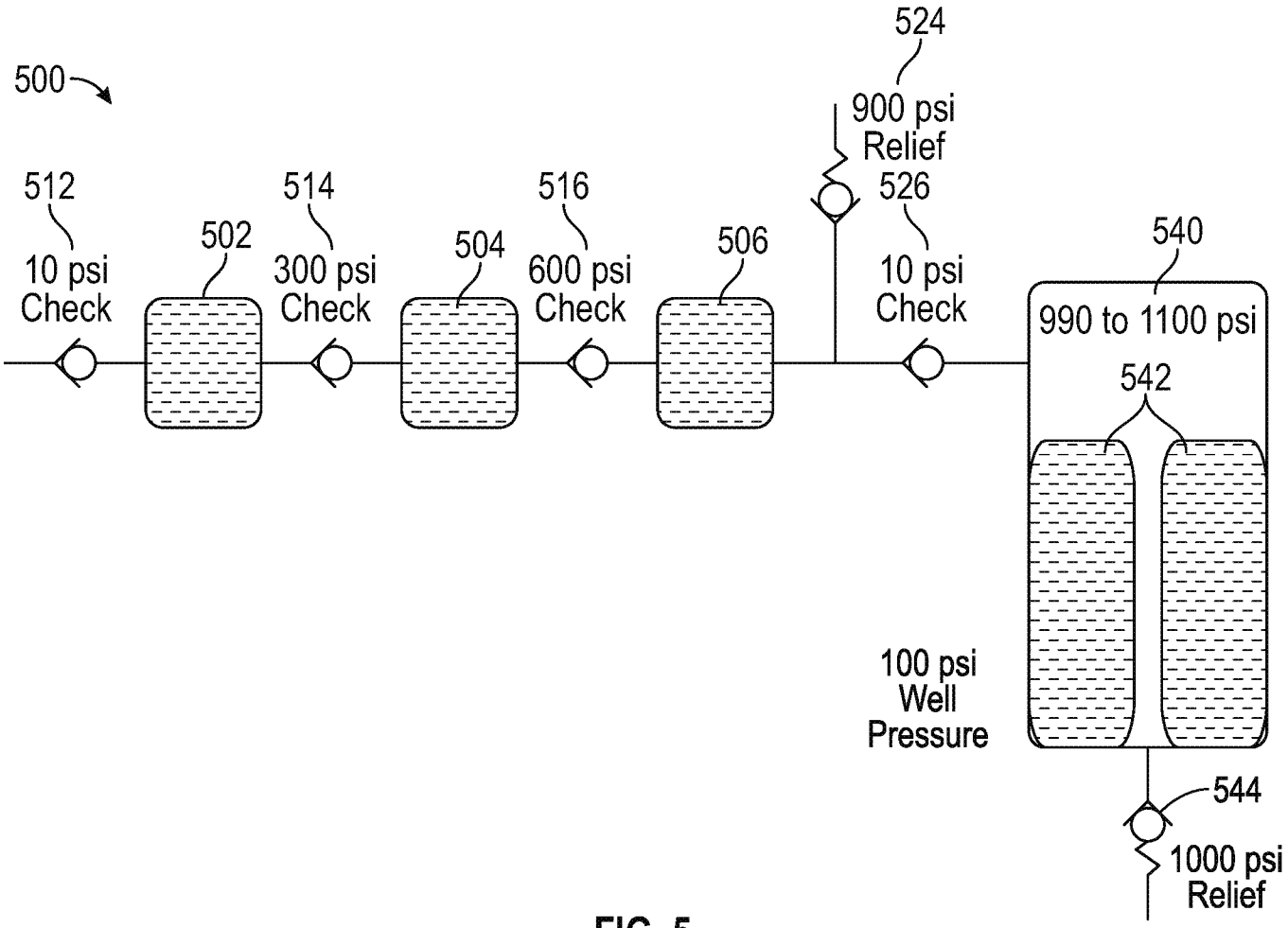
FIG. 5 is a schematic view of an exemplary on-demand downhole chemical reactor with a pressure accumulator system to provide a continuous pressure reservoir based on downhole variations.

FIG. 5 depicts an embodiment which provides a reactor controller comprising a pressure accumulator system 500. Using one or more pressure accumulators, the reactor controller drives a downhole chemical reactor 540 to provide a constant pressure reservoir via the aforementioned gas generation reaction(s). Downhole chemical reactor 540 can be similar or identical to one or more of the previously discussed reactors 240, 340, 440. The pressure accumulators 502-506 of this pressure accumulator reactor controller contain well fluid and can still be driven by temperature swings within the wellbore/downhole environment, but exhibit a lesser thermal expansion and contraction effect than the phase change material within phase change pumps 402-406 of the phase change pump reactor controller, e.g. a thermal expansion and contraction of <<1% as compared to 10-20%. However, relatively large fluid volumes are available such that even a small variation over these large volumes can be sufficient to pump the small volumes required for downhole chemical reactor 540 to perform the gas generation reaction.

When the wellbore temperature is relatively cool, then well fluid flows into the pressure accumulator system via check valve 512 on the inlet of pressure accumulator 502. When the wellbore temperature is relatively hot, then well fluid flows out of the pressure accumulator system 500 and into an intermediate coupling between third pressure accumulator 506 and the downhole chemical reactor 540. Similar to the phase change pump system 400 of FIG. 4, this intermediate coupling will either discharge through a 900 psi relief valve 524 if the pressure of the intermediate coupling exceeds its maximum of 1000 psi, or the intermediate coupling will discharge through a 10 psi check valve 526 and into the downhole chemical reactor 540 if the reactor pressure drops below 990 psi.

Similar to the downhole chemical reactor 440 of FIG. 4, the downhole chemical reactor 540 has a minimum pressure of 990 psi (determined by the 100 psi well pressure, the 900 psi relief valve 524, and the 10 psi check valve 526) and a maximum pressure of 1100 psi (determined by the 100 psi well pressure and the 1000 psi relief valve 544), although of course other pressure values are possible without departing from the scope of the present disclosure.

In some embodiments, the pressure accumulator system 500 can be provided as a single pressure accumulator volume, rather than the three pressure accumulators 502-506 that are shown. However, by varying the check valve values between the three pressure accumulators (i.e. 10 psi check valve 512 on the input to first pressure accumulator 502; 300 psi check valve 514 on the input to second pressure accumulator 504; 600 psi check valve on the input to third pressure accumulator 506), the pressure accumulator system 500 as a whole is more efficient and better able to convert small temperature changes into a pumped output.

In addition to temperature variations, pressure accumulator system 500 can also be driven by pressure variations within the wellbore environment. In some embodiments, pressure accumulator system 500 can be isolated from the downhole chemical reactor 540, such that they are not necessarily exposed to the same external pressure. For example, pressure accumulator system 500 could be located in the annulus of the wellbore and downhole chemical reactor 540 could be located in the section of the wellbore. In this manner, pressure accumulator system 500 could more easily be exposed to pressure changes to drive its pumping action, while downhole chemical reactor 540 stays relatively isolated from any changes. Additionally, active means can be taken from the surface to drive the pressure accumulator system 500 for example by shutting in the well or by pumping into the annulus to increase its pressure specifically to force additional well fluid through the pressure accumulators 502-506 and into the downhole chemical reactor 540 until the reactor has been sufficiently re-pressurized.

For clarity of explanation, in some instances the present technology may be presented as including individual functional blocks including functional blocks comprising devices, device components, steps or routines in a method embodied in software, or combinations of hardware and software.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that one member of the set or multiple members of the set satisfy the claim.

Numerous examples are provided herein to enhance understanding of the present disclosure. A specific set of statements are provided as follows.

STATEMENTS OF THE DISCLOSURE INCLUDE

Statement 1: A downhole pressure generation system comprising: a chemical reactor having an inner pressure chamber, wherein the chemical reactor is located within a wellbore; a chemical reactant disposed within the inner pressure chamber, wherein the chemical reactant is reactive with at least a first fluid to generate one or more gases to pressurize the inner pressure chamber of the chemical reactor; a reactor controller coupled to an inlet of the inner pressure chamber in order to permit well fluid to flow from the wellbore and into the inner pressure chamber, wherein the well fluid contains at least the first fluid; and a pressure regulator coupled to the inner pressure chamber in order to control a maximum pressurization of the inner pressure chamber.

Statement 2: The downhole pressure generation system of statement 1, wherein the reactor controller comprises one or more pumps, each pump comprising a phase change compartment and a fluid compartment divided by a movable partition, such that: a temperature decrease in the wellbore causes the well fluid to flow into an inlet of the fluid compartment in response to a material in the phase change compartment solidifying, where the material solidifying reduces the volume of the phase change compartment and increases the volume of the fluid compartment; and a temperature increase in the wellbore causes the well fluid to discharge from an outlet of the fluid compartment and flow into the inner pressure chamber in response to the material in the phase change compartment melting, where the material melting increases the volume of the phase change compartment and decreases the volume of the fluid compartment.

Statement 3: The downhole pressure generation system of statement 1 or 2, wherein the reactor controller further comprises: a common conduit connected to the outlet of each phase change pump and the inlet of the inner pressure chamber, such that well fluid received within the common conduit will discharge into the inlet of the inner pressure chamber if a pressure within the common conduit is greater than a pressure within the inner pressure chamber; and a pressure relief valve disposed on the common conduit before the inlet of the inner pressure chamber, such that well fluid received within the common conduit will discharge through the pressure relief valve and into the wellbore if the pressure within the common conduit exceeds a set pressure of the pressure relief valve.

Statement 4: The downhole pressure generation system of statement 3, wherein the material in the phase change compartment is a wax.

Statement 5: The downhole pressure generation system of statement 4, wherein the material comprises an aliphatic hydrocarbon having a melting point of at least 200° F.

Statement 6: The downhole pressure generation system of any one of the preceding statements 1-5, wherein the reactor controller comprises two or more pressure accumulator stages, wherein: well fluid flows from the wellbore and into a first pressure accumulator stage via a first inlet having a first check valve; well fluid flows from a first outlet of the first pressure accumulator stage to a second inlet of a second pressure accumulator stage, wherein the first outlet and second inlet are connected by a second check valve having a greater cracking pressure than the first check valve; and well fluid flows from a second outlet of the second pressure accumulator stage and into the inner pressure chamber of the chemical reactor.

Statement 7: The downhole pressure generation system of any one of the preceding statements 1-6 wherein the reactor controller further comprises: an intermediate coupling connected to an outlet of a final one of the two or more pressure accumulator stages and to an inlet of the inner pressure chamber, such that well fluid received within the intermediate coupling from the final one of the two or more pressure accumulator stages will discharge into the inlet of the inner pressure chamber if a pressure within the intermediate coupling is greater than a pressure within the inner pressure chamber; and a pressure relief valve disposed on the intermediate coupling before the inlet of the inner pressure chamber, such that well fluid received within the intermediate coupling will discharge through the pressure relief valve and into the wellbore if the pressure within the common conduit exceeds a set pressure of the pressure relief valve.

Statement 8: The downhole pressure generation system of any one of the preceding statements 1-7, wherein the reactor controller comprises a check valve configured to open the inlet of the inner pressure chamber when a pressure of the wellbore exceeds a pre-determined cracking pressure of the check valve.

Statement 9: The downhole pressure generation system of any one of the preceding statements 1-8, wherein the reactor controller comprises: a first valve coupled to an upper portion of the inner pressure chamber; and a second valve coupled to a lower portion of the inner pressure chamber; wherein opening the first valve and the second valve causes gas to discharge from the inner pressure chamber via the first valve until a pressure of the inner pressure chamber is substantially equal to a pressure of the wellbore and causes well fluid to flow from the wellbore and into the inner pressure chamber via the second valve.

Statement 10: The downhole pressure generation system of any one of the preceding statements 1-9, wherein the reactor controller comprises a large-diameter valve coupled to the inner pressure chamber such that opening the large-diameter valve: causes gas to discharge from the inner pressure chamber via a first portion of the large-diameter valve until a pressure of the inner pressure chamber is substantially equal to a pressure of the wellbore; and causes well fluid to flow from the wellbore and into the inner pressure chamber via a second portion of the large-diameter valve.

Statement 11: The downhole pressure generation system of any one of the preceding statements 1-10, wherein the reactor controller comprises a pump located within the wellbore, the pump having an inlet for the uptake of well fluid from the wellbore and an outlet for the discharge of the well fluid into the inlet of the inner pressure chamber.

Statement 12: The downhole pressure generation system of statement 11, wherein the pump is an electrical pump.

Statement 13: The downhole pressure generation system of statement 12, further comprising: a downhole battery, the battery electrically coupled to power at least the electrical pump; and a receiver operable to receive one or more control commands and adjust the operation of the electrical pump based at least in part on the one or more control commands.

Statement 14: The downhole pressure generation system of any one of the preceding statements 1-13, wherein the chemical reactant comprises one or more of: a magnesium alloy, an aluminum alloy, a zinc alloy, calcium, and a metal hydroxide.

Statement 15: The downhole pressure generation system of any one of the preceding statements 1-14, wherein the one or more generated gases comprise one or more of hydrogen and carbon dioxide.

Statement 16: The downhole pressure generation system of any one of the preceding statements 1-15, wherein the pressure regulator coupled to the inner pressure chamber comprises a pressure relief valve and the maximum pressurization of the inner pressure chamber is based on at least a set pressure of the pressure relief valve and a pressure of the wellbore.

Statement 17: The downhole pressure generation system of statement 16, wherein the pressure relief valve is configured to automatically discharge at least well fluid from the inner pressure chamber in response to the maximum pressurization of the inner pressure chamber being exceeded.

Statement 18: The downhole pressure generation system of statement 17, wherein the pressure relief valve is located beneath the inner pressure chamber such that the well fluid from the inner pressure chamber discharges before any generated gas within the inner pressure chamber.

We claim:

1. A downhole pressure generation system comprising:

a chemical reactor having an inner pressure chamber, wherein the chemical reactor is located within a wellbore;

a chemical reactant disposed within the inner pressure chamber, wherein the chemical reactant is reactive with at least a first fluid to generate one or more gases to pressurize the inner pressure chamber;

a reactor controller apparatus coupled to an inlet of the inner pressure chamber and configured to generate pressure at multiple times in an on-demand fashion by permitting well fluid to flow from the wellbore and into the inner pressure chamber at each of the multiple times, wherein the well fluid contains at least the first fluid, and, for each of the multiple times, the chemical reactant reacts to at least the first fluid and generates the one or more gases that pressurize the inner pressure chamber; and a pressure regulator apparatus coupled to the inner pressure chamber, wherein the pressure regulator apparatus controls a maximum pressurization of the inner pressure chamber, and includes a pressure relief valve located beneath the inner pressure chamber to discharge the well fluid from the inner pressure chamber when the pressure within the inner pressure chamber meets a threshold pressure.

2. The downhole pressure generation system of claim 1, wherein the reactor controller apparatus comprises one or more pumps, each of the one or more pumps comprise a phase change compartment and a fluid compartment divided by a movable partition apparatus, such that:

a temperature decrease in the wellbore causes the well fluid to flow into an inlet of the fluid compartment in response to a material in the phase change compartment solidifying, wherein the material solidifying in the phase change compartment reduces a volume of the phase change compartment and increases the volume of the fluid compartment; and a temperature increase in the wellbore causes the well fluid to discharge from an outlet of the fluid compartment and flow into the inner pressure chamber in response to the material in the phase change compartment melting, wherein the material melting in the phase change compartment increases the volume of the phase change compartment and decreases the volume of the fluid compartment.

3. The downhole pressure generation system of claim 2, wherein the reactor controller apparatus further comprises:

a common conduit connected to the outlet of each phase change pump and the inlet of the inner pressure chamber, such that well fluid received within the common conduit will discharge into the inlet of the inner pressure chamber if a pressure within the common conduit is greater than a pressure within the inner pressure chamber; and a pressure relief valve disposed on the common conduit before the inlet of the inner pressure chamber, such that well fluid received within the common conduit will discharge through the pressure relief valve and into the wellbore if the pressure within the common conduit exceeds a set pressure of the pressure relief valve.

4. The downhole pressure generation system of claim 2, wherein the material in the phase change compartment is a wax.

5. The downhole pressure generation system of claim 2, wherein the material comprises an aliphatic hydrocarbon having a melting point of at least 200° F.

6. The downhole pressure generation system of claim 1, wherein the chemical reactant comprises one or more of: a magnesium alloy, an aluminum alloy, a zinc alloy, calcium, and a metal hydroxide.

7. The downhole pressure generation system of claim 1, wherein the one or more generated gases comprise one or more of hydrogen and carbon dioxide.

8. The downhole pressure generation system of claim 1, wherein the pressure regulator apparatus coupled to the inner pressure chamber comprises the pressure relief valve and the maximum pressurization of the inner pressure chamber is based on at least a set pressure of the pressure relief valve and a pressure of the wellbore.

9. The downhole pressure generation system of claim 8, wherein the pressure relief valve is configured to automatically discharge at least well fluid from the inner pressure chamber in response to the maximum pressurization of the inner pressure chamber being exceeded.

10. The downhole pressure generation system of claim 1, wherein the reactor controller apparatus generates pressure at multiple times in an on-demand fashion based on one or more control commands.

* * * * *